US007504999B2

(12) United States Patent
Brown

(10) Patent No.: US 7,504,999 B2
(45) Date of Patent: Mar. 17, 2009

(54) AMPLIFIED PATCH ANTENNA REFLECT ARRAY

(75) Inventor: Kenneth W. Brown, Yucaipa, CA (US)

(73) Assignee: Raytheon Company, Waltham, MA (US)

( * ) Notice: Subject to any disclaimer, the term of this patent is extended or adjusted under 35 U.S.C. 154(b) by 192 days.

(21) Appl. No.: 11/508,086

(22) Filed: Aug. 22, 2006

(65) Prior Publication Data

US 2008/0048916 A1 Feb. 28, 2008

(51) Int. Cl.
*H01Q 1/38* (2006.01)
*H01Q 21/26* (2006.01)

(52) U.S. Cl. ..... 343/700 MS; 343/795; 343/797

(58) Field of Classification Search ..... 343/700 MS, 343/793, 795, 797
See application file for complete search history.

(56) References Cited

U.S. PATENT DOCUMENTS 5,280,297 A * 1/1994 Profera, Jr. ..... 343/754
5,982,245 A * 11/1999 Matsui et al. ..... 331/99
6,246,295 B1 * 6/2001 Matsui et al. ..... 331/99
6,847,328 B1 * 1/2005 Libonati et al. ..... 343/700 MS
6,870,513 B2 * 3/2005 Deng et al. ..... 343/795
7,298,344 B2 * 11/2007 Brown ..... 343/797
2005/0243527 A1 * 11/2005 Jandzio et al. ..... 361/760
2007/0194991 A1 * 8/2007 Mohamadi ..... 343/700 MS

* cited by examiner

*Primary Examiner*—Tan Ho
(74) *Attorney, Agent, or Firm*—John J. Horn

(57) ABSTRACT

A reflect array antenna including a plurality of unit cells. Each cell includes first, second, third and fourth patch antenna segments. An amplifier is coupled between said first patch segment and the second patch segment or the third patch segment and the fourth patch segment. At least one of the patch antenna segments of a first unit cell is electrically connected to a patch antenna segment of a second unit cell. The first patch antenna segment of a first unit cell is electrically connected to a third patch segment of a second unit cell. Each patch segment of each unit cell is electrically connected to a patch segment of a neighboring cell. The first and third patche segments are the input terminals of each cell and the second and fourth patch segments of each cell are the output terminals. The output terminals of each cell are coupled to the output terminals of neighboring cells. This provides an output patch antenna, of greater area, fed by multiple cells.

37 Claims, 5 Drawing Sheets

AMPLIFIED PATCH ANTENNA REFLECT ARRAY

BACKGROUND OF THE INVENTION

1. Field of the Invention

The present invention relates to antennas. More specifically, the present invention relates to millimeter wave reflect patch antennas and arrays thereof and components therefor.

2. Description of the Related Art

As noted by the Institute of Electrical and Electronic Engineers (IEEE): "The millimeter-wave region of the electromagnetic spectrum is usually considered to be the range of wavelengths from 10 millimeters (0.4 inches) to 1 millimeter (0.04 inches). This means they are larger than infrared waves or x-rays, for example, but smaller than radio waves or microwaves. The millimeter-wave region of the electromagnetic spectrum corresponds to radio band frequencies of 30 GHz to 300 GHz and is sometimes called the Extremely High Frequency (EHF) range. The high frequency of millimeters waves as well as their propagation characteristics (that is, the ways they change or interact with the atmosphere as they travel) make them useful for a variety of applications including transmitting large amounts of computer data, cellular communications, and radar." See http://www.ieee-virtual-museum.org/collection/tech.php?id=2345917&lid=1.

For current more demanding applications, such as 'active denial', higher power millimeter waves, i.e. waves in the range of tens to thousands of watts, are required. Prior attempts to produce high power millimeter wave energy with solid-state devices have included waveguide and microstrip power combining. At millimeter wave frequencies, this method of combining typically produces unsatisfactory results due to heavy losses in the waveguide and/or microstrip medium.

Another approach is a spatial array technique. This technique has shown some promise. However, spatial arrays have not yet produced the power density levels that are required for the more demanding applications mentioned above.

One current approach involves the use of a reflect array amplifier. The reflect array has independent unit cells, each containing its own input antenna, power amplifier, and output antenna. These unit cells are then configured into an array of arbitrary size. Reflect arrays overcome feed losses by feeding each element via a nearly lossless free-space transmission path. As disclosed and claimed in U.S. patent application Ser. No. 10/734,445, entitled REFLECTIVE AND TRANSMISSIVE MODE MONOLITHIC MILLIMETER WAVE ARRAY SYSTEM AND IN-LINE AMPLIFIER USING SAME, filed Dec. 12, 2003 by K. Brown et al. (Atty. Docket No. PD 01W176A), the teachings of which are hereby incorporated herein by reference, reflect arrays differ from conventional arrays in that the input signal is delivered to the face of the array via free space, generally from a small horn antenna.

An active reflect array consists of a large number of unit cells arranged in a periodic pattern. Each reflect array element is equipped with two orthogonally-polarized antennas, one for reception and one for transmission. That is, reflect arrays typically receive one linear polarization and radiate the orthogonal polarization, e.g., the receive antenna receives only vertically-polarized radiation and the transmit antenna transmits only horizontally-polarized radiation.

When integrated with the power-generating electronics on a thin semiconductor substrate, such antennas tend to have narrow bandwidths and high losses due to large surface currents. The size of each unit cell is constrained by the need to avoid grating lobes; for a fixed array whose main beam is in the broadside direction, each unit cell may be no more than approximately 0.8 wavelengths on a side.

Higher power levels are attained by combining the outputs of multiple transistors. The drawback of this approach is that the power combiners themselves take up valuable area on the semiconductor wafer that could otherwise be occupied by power-generating circuitry.

Hence, a need remains in the art for improved systems and methods for generating high power millimeter wave beams. Specifically, a need remains in the art for a reflect array antenna capable of generating high power millimeter wave energy without significant loss.

SUMMARY OF THE INVENTION

The need in the art is addressed by the reflect array antenna of the present invention. In the illustrative embodiment, the array includes a plurality of unit cells. Each cell includes first, second, third and fourth patch antennas. An amplifier is coupled between said first patch and the second patch or the third patch and the fourth patch. At least one of the patch antennas of a first unit cell is electrically coupled to a patch antenna of a second unit cell.

In a more specific embodiment, the first patch antenna of a first unit cell is electrically coupled to a third patch of a second unit cell. Each patch of each unit cell is electrically coupled to a patch of a neighboring cell. In the illustrative embodiment, the first and third patches are the input terminals of each cell and the second and fourth patches of each cell are the output terminals. In accordance with the invention, the output terminals of each cell are coupled to the output terminals of neighboring cells. This provides an output antenna, of greater area, fed by multiple cells.

In the illustrative embodiment, the amplifiers are implemented with MHEMT (Metamorphic High Electron Mobility Transistor) transistors. Direct current for the amplifiers is supplied via the output terminals (the second and fourth patch antennas) of neighboring cells. Input bias for each amplifier is supplied to each cell via the first or third patches of neighboring cells.

The amplifier and patches of each cell are optimized as one unit to mitigate interference between the power amplifier and the patches. In accordance with the invention, the array antenna is terminated to appear as an infinite antenna.

The inventive array operates in reflection mode. That is, the inventive array receives a low power radio frequency (RF), microwave or millimeter wave signal, amplifies it, and then re-radiates it at a much higher power level. This technique is used to generate high power at millimeter wave frequencies without suffering the debilitating losses one gets when using a waveguide or microstrip line feed network.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
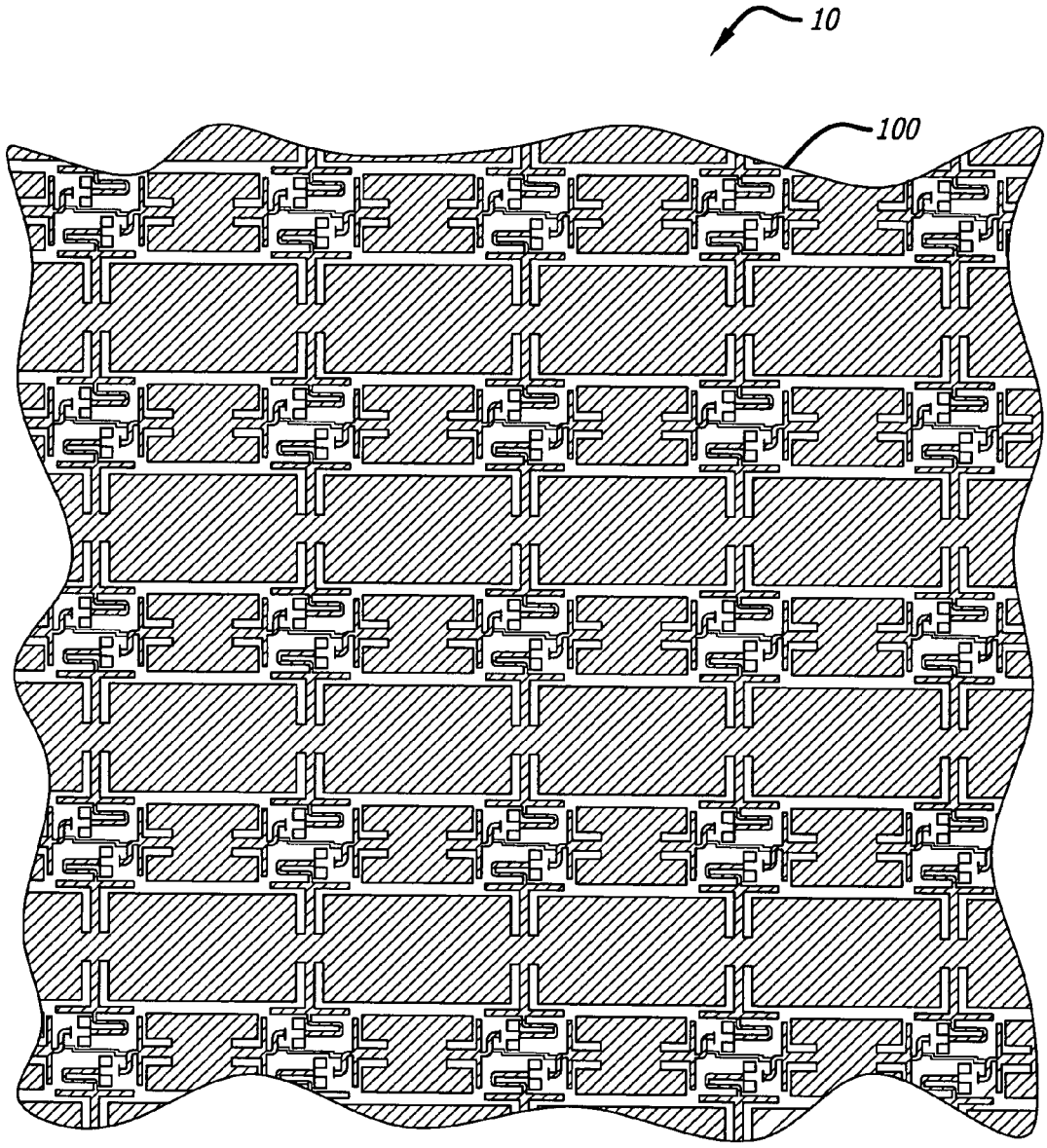
FIG. 1 is a topological view of a reflection mode amplified patch antenna unit cell array constructed in accordance with an illustrative embodiment of the present teachings.

FIG. 1 is a topological view of a reflection mode amplified patch antenna unit cell array constructed in accordance with an illustrative embodiment of the present teachings. The amplified patch antenna array 10 of the present invention is comprised of many unit cells 100 combined together to form an array. By combining unit cells 100, an array 10 of arbitrary size is implemented.

Figure 2:
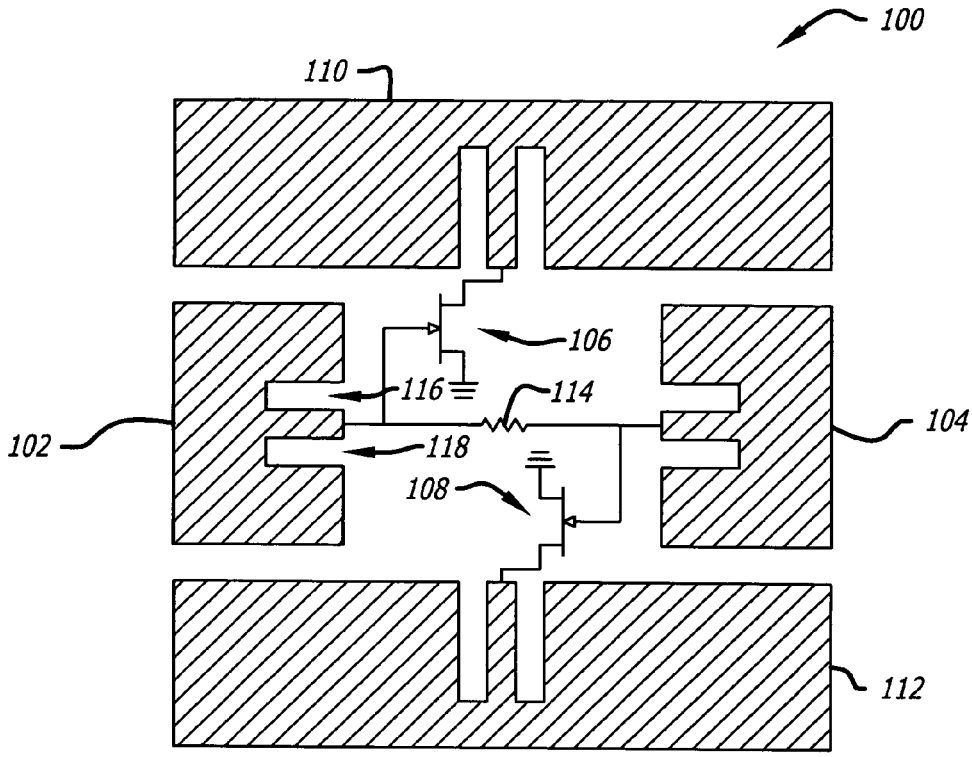
FIG. 2 is a schematic diagram of a unit cell of the array of FIG. 1.

FIG. 2 is a schematic diagram of a unit cell 100 of the array 10 of FIG. 1. Each unit cell is fabricated in a conventional manner by depositing a layer of metallization (such as gold or other suitably conductive material) on a substrate (of Gallium Arsenide or other suitable dielectric) to provide a circuit. The unit cell 100 has two opposing input patch antenna segments 102 and 104, two opposing amplifiers 106 and 108 and two opposing output patch antenna segments 110 and 112. The first input patch antenna segment 102 is coupled to an input (gate) terminal of the first amplifier 106. In the illustrative embodiment, the first amplifier is a MHEMT transistor coupled with appropriate bais and matching networks. The output (source) terminal of the transistor 106 is connected to the first output patch 106. The drain terminal is connected to the backside ground plane through metalized via holes. The second input patch 104, second amplifier 108 and second output patch 112 mirror the arrangement of the first input patch 102, first amplifier 106 and first output patch 110. The gate terminals of the first and second amplifiers 106 and 108 are coupled via a gate bias resistor 114. This allows the gate bias voltage to propagate to the next unit cell through the shared input patch antenna.

Notches (such as 116 and 118) change input impedance and are therefor provided for impedance matching as is common in the art.

The array of FIG. 1 is formed by fabricating a plurality of unit cells and combining the patch antenna segments thereof. That is, each patch segment of each unit cell is electrically coupled to a patch of a neighboring cell to form the overall patch antenna. As illustrated in FIG. 1, adjacent unit cells in a row share input patch segments and output patch segments. Hence, the input patch segments in this topology double in size to form an input patch antenna and the output patch segments combine into large multiple-terminal patch antennas (depending upon the size of the array), one for each row. For example, in the illustrative embodiment, in accordance with the present teachings, cells in adjacent rows in the array share a large single output patch antenna. As an alternative, the large output patch could be implemented via columns instead of rows without departing from the scope of the present teachings.

The large size of the output patches is very advantageous in that it should have very low loss and a high bandwidth. The input patch antenna is smaller and thus has more loss and a narrower bandwidth. Note that the larger patch could be possibly used for the input. However, since the output is high power, the efficiency of the array is optimal if the large patch is used for the output. A lower efficient input patch antenna can be compensated for by including an additional gain stage in the amplifier without significantly detracting from the overall unit cell efficiency.

Also note that the amplifier drain bias comes directly through the output patch antenna. The amplifier gate bias comes through the input patch antennas. That is, each input patch antenna along a row in the array is DC interconnected through the gate bias resistor 114. Thus the array 100 may be fed with DC along the left, right, or both sides of the chip.

While each cell is shown in FIG. 2 with dual amplifiers, those skilled in the art will appreciate that the invention is not limited thereto. One or more cells may be implemented with a single amplifier or multiple amplifiers. With a single amplifier design, one input patch may feed one or more output patches of a cell. In the array of FIG. 1, the unused input patches in a cell could be used by an adjacent cell. Likewise, any unfed output patches could be fed by other cells in the shared row. Although the unit cell shown in FIGS. 2 and 3 include a pair of single stage amplifiers, multiple stage amplifiers can also be utilized within the scope of this invention.

In the best mode, the amplifier and patches of each cell are optimized as one unit to mitigate interference between the power amplifier and the patches. In accordance with the invention, the array antenna is terminated to appear as an infinite antenna.

Figure 3:
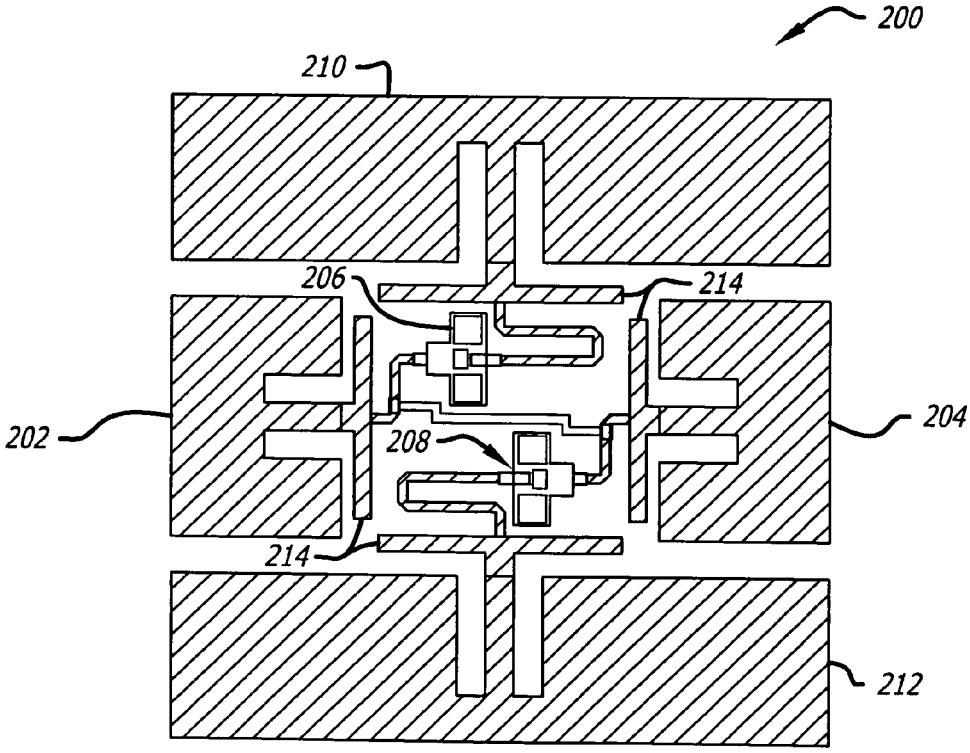
FIG. 3 is a schematic diagram of an alternative embodiment of the unit cell of FIG. 2 using MHEMT technology.

FIG. 3 is a schematic diagram of an alternative embodiment of the unit cell of FIG. 2 using MHEMT (Metamorphic High Electron Mobility Transistor) technology. MHEMT technology is known in the art. For more on MHEMT technology, see the following illustrative sites http://en.wikipedia.org/wiki/MHEMT and http://www.compoundsemiconductor.net/articles/news/5/9/39/1. In FIG. 3, the first and second transistors 206 and 208 are implemented in MHEMT. Note the inclusion of tuning elements 214 in this embodiment.

Figure 4:
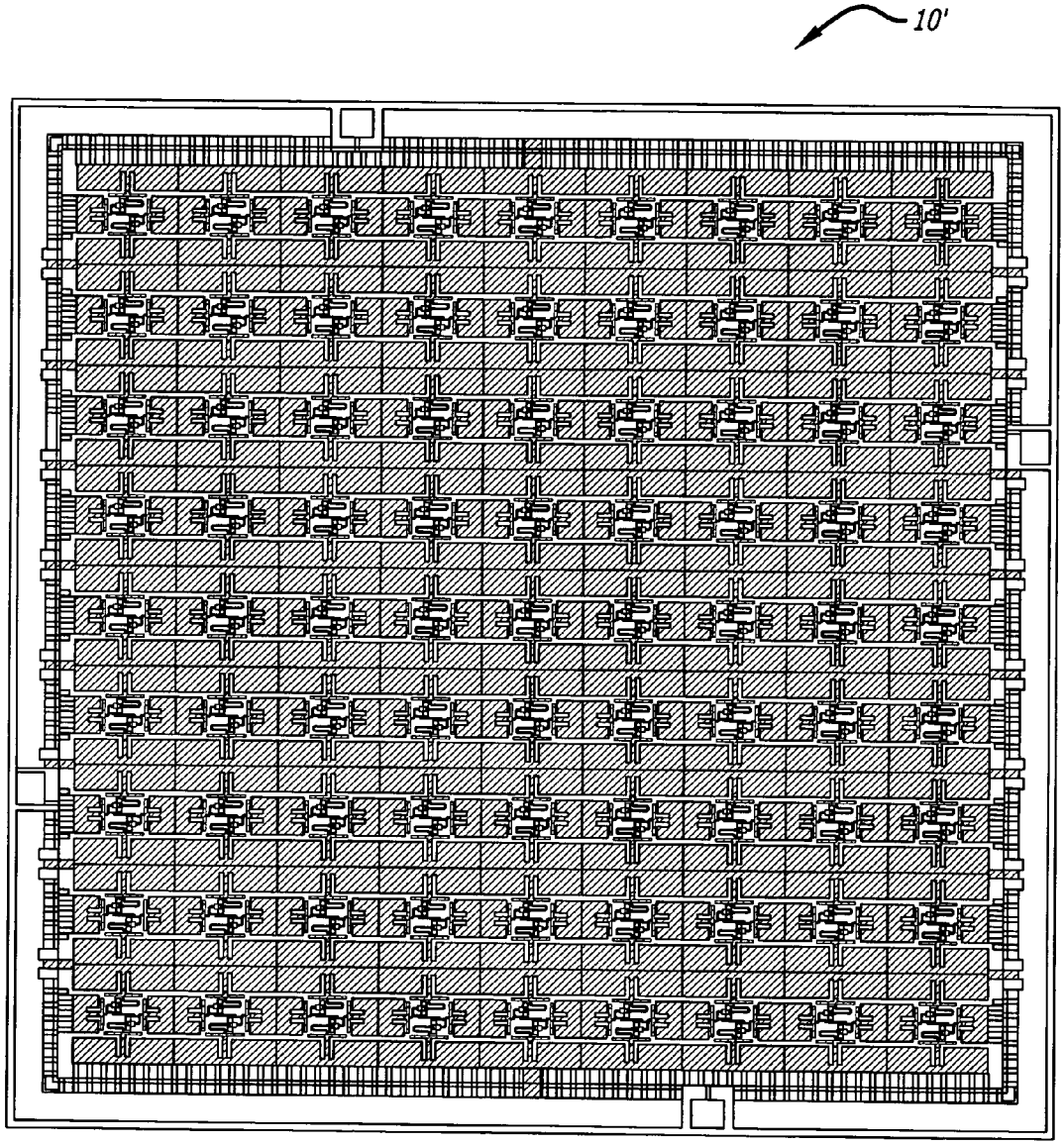
FIG. 4 is a topological view of a reflection mode amplified patch antenna array using unit cells illustrated in FIG. 3 constructed with MHEMT technology.

FIG. 4 is a topological view of a reflection mode amplified patch antenna array 10' using unit cells illustrated in FIG. 3 constructed with MHEMT technology.

Figure 5:
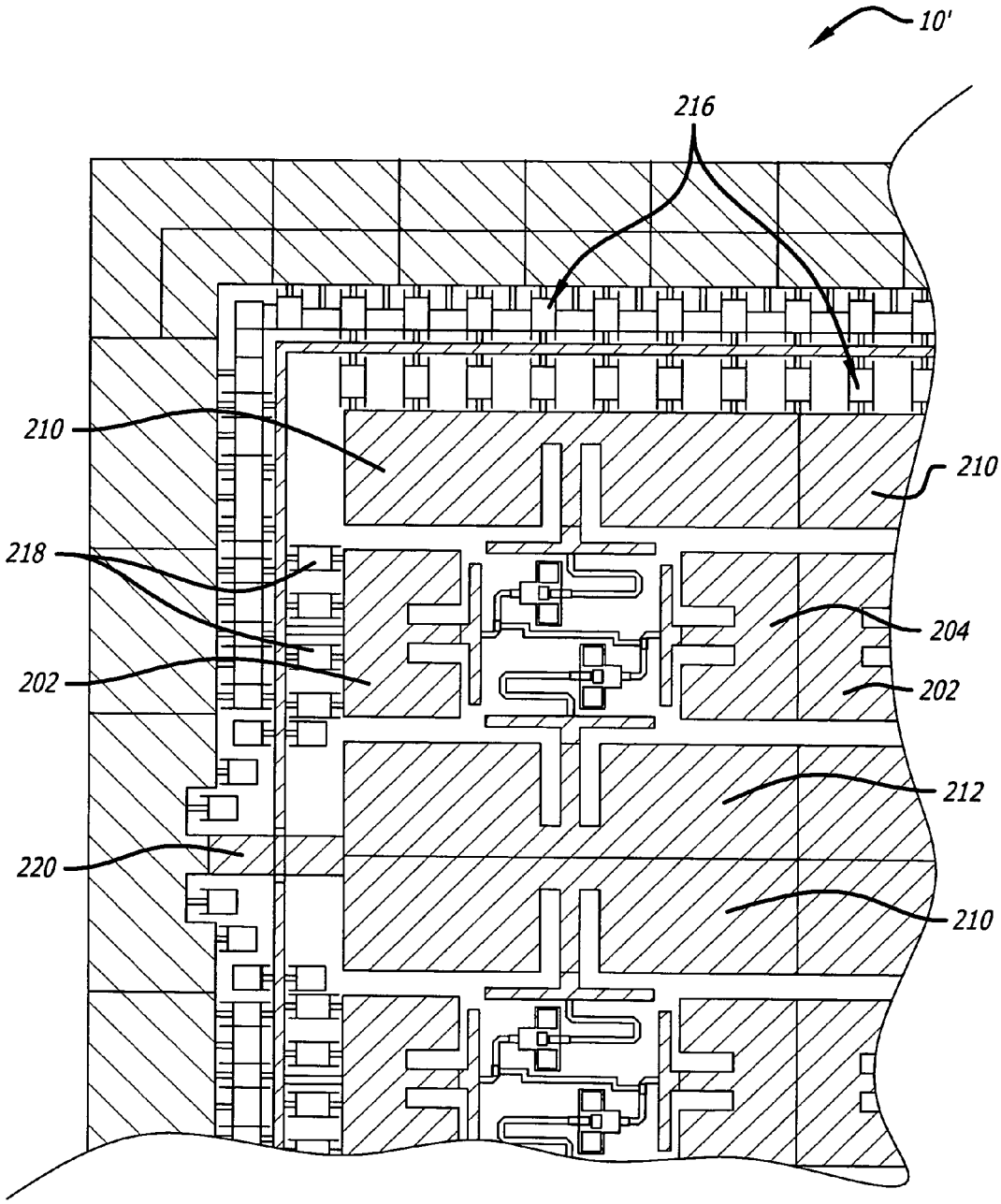
FIG. 5 is a magnified view of a corner of the array of FIG. 4 illustrating patch termination and use for DC bias.

FIG. 5 is a magnified view of a corner of the array of FIG. 4 illustrating patch termination and use for DC bias. FIG. 5 shows how the array is DC biased and how the patch antennas are terminated in accordance with the present teachings. Note that the patch antennas receive and radiate RF (radio frequency) energy and transport DC bias. Therefore, the patch antennas must be connected to the DC bias in such a way as to not disrupt the RF functionality thereof. In addition, from an RF perspective, the array is designed as an infinite array using a conventional design tool such as HFSS (High Frequency Structure Simulated) or Designer both by Ansoft Inc. of Pittsburgh, Pa.

For example, the output patch 210 along the top of the chip is terminated into an RF ground with multiple RF shorts 216. The patch antennas in this invention are fed on both sides. In order to properly combine the powers going into the patch, the amplifier output voltages (feeding the patch antenna inputs on opposing sides of the patches) are 180 degrees out-of-phase. Due to this 180 degree out-of-phase feeding arrangement, a virtual short exists along the centerline of each patch antenna. Therefore, in order to properly terminate the patch antenna array, an RF grounded half-length patch antenna is used along the top (and bottom) ends of the chip for the output patches.

The input patches are terminated in a likewise fashion at the left and right side of the chip with multiple RF shorts 218. In addition, the input patches on the left and right sides of the chip are fed with a DC gate bias voltage.

Finally, the output patch 212 at the left and right side of the chip is terminated into an RF open circuit via a termination 220. This is accomplished by connecting a quarter-wavelength shorted line at each end of the output patch. This line is also used to feed the output patch 212 with DC drain bias. Note that the output patches of one row of cells 210 and the output patches of a lower row of cells 212 are DC electrically and, in the illustrative embodiment, physically coupled.

This topology offers more room for the amplifiers by sharing antennas between unit cells. It offers the potential to produce more power than previous reflect array topologies.

Figure 6:
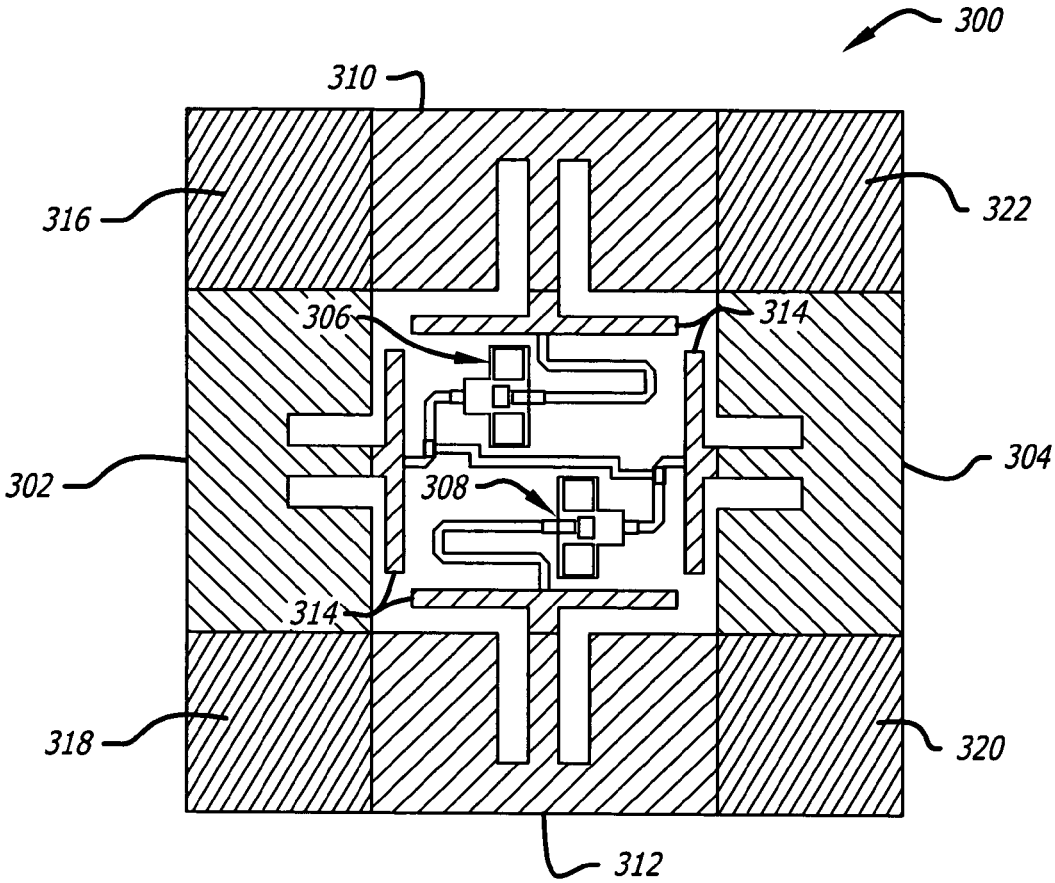
FIG. 6 shows an amplified patch antenna array unit cell topology in accordance with an alternative embodiment of the present teachings.

FIG. 6 shows an amplified patch antenna array unit cell topology in accordance with an alternative embodiment of the present teachings. Here the input patch antennas 302 and 304 are also long and continuous (as per the output patch antennas 310 and 312). The input (or output) patch antennas are deployed over the output (or input) patch antennas via "air bridges" 316-322 (even numbers only) so they do not electrically touch each other. In this alternate topology, the gate bias resistor would not be needed, since the input patch is continuous as shown.

The inventive array operates in reflection mode. That is, it receives a low power RF, microwave or millimeter wave signal, amplifies it, and then re-radiates it at a much higher power level. This technique is used to generate high power at millimeter wave frequencies without suffering the debilitating losses associated with use of a waveguide or microstrip line feed network.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. An antenna cell comprising:

a first patch antenna segment;

a second patch antenna segment;

a third patch antenna segment;

a fourth patch antenna segment, said first and second patch segments being disposed in a mutually orthogonal relationship and said third and fourth patch segments being disposed in a mutually orthogonal relationship, said first and third patch segments being disposed in a mutually parallel relationship and said second and fourth patch segments being disposed in a mutually parallel relationship; and a first amplifier coupled between said first patch segment and said second patch segment;

a second amplifier coupled between said third patch segment and said fourth patch segment; and means for coupling an input of said first amplifier to an input of said second amplifier.

2. The invention of claim 1 wherein said means for coupling is a resistor.

3. The invention of claim 1 wherein an input terminal of said first amplifier is coupled to said first patch antenna segment.

4. The invention of claim 3 wherein an output terminal of said first amplifier is coupled to said second patch antenna segment.

5. The invention of claim 4 wherein an input terminal of said second amplifier is coupled to said third patch antenna segment.

6. The invention of claim 5 wherein an output terminal of said second amplifier is coupled to said fourth patch antenna segment.

7. The invention of claim 6 wherein said first and said third patch segments are input patch segments and said second and fourth patch segments are output patch segments.

8. The invention of claim 7 further including a timing element between at least one of said patches and at least one of said amplifiers.

9. The invention of claim 8 wherein each of said amplifiers includes a field-effect transistor.

10. The invention of claim 1 wherein said amplifier and said patches are optimized as one unit.

11. The invention of claim 1 wherein one or more of said patches are impedance matched.

12. The invention of claim 11 wherein one or more of said patches are notched for impedance matching.

13. A reflect array antenna comprising:

a plurality of unit cells, each cell comprising:

a first patch antenna segment;

a second patch antenna segment;

a third patch antenna segment;

a fourth patch antenna segment; and an amplifier coupled between said first patch segment and said second patch segment or said third patch segment and said fourth patch segment;

wherein at least one of said patch antenna segments of a first unit cell is electrically connected to a patch antenna segment of a second unit cell and a bias current for said amplifier is applied to each cell via the second and/or fourth patch patch segments thereof via second and/or fourth patch segments of neighboring cells and a bias voltage for said amplifier is applied to each cell via the first and/or third patch segments thereof via first and/or third patch segments of neighboring cells.

14. The invention of claim 13 wherein said first patch antenna segment of a first unit cell is electrically connected to a third patch segment of a second unit cell.

15. The invention of claim 13 wherein each patch antenna segment of each unit cell is electrically connected to a patch antenna segment of a neighboring cell.

16. The invention of claim 15 wherein the second patch antenna segment of each cell is an output terminal thereof.

17. The invention of claim 16 wherein the fourth patch antenna segment of each cell is an output terminal thereof.

18. The invention of claim 17 wherein the output terminals of each cell are electrically coupled to the output terminals of neighboring cells.

19. The invention of claim 13 wherein an input terminal of said first amplifier of each cell is coupled to said first patch antenna thereof.

20. The invention of claim 19 wherein an output terminal of said first amplifier of each cell is coupled to said second patch antenna segment thereof.

21. The invention of claim 20 wherein an input terminal of said second amplifier of each cell is coupled to said third patch antenna segment thereof.

22. The invention of claim 21 wherein an output terminal of said second amplifier of each cell is coupled to said fourth patch antenna segment thereof.

23. The invention of claim 22 wherein said first and said third patch segments of each cell are input patch segments and said second and fourth patch segments of each cell are output patch segments.

24. The invention of claim 23 further including a tuning element between at least one of said patch segments and at least one of said amplifiers.

25. The invention of claim 24 wherein each of said amplifiers includes a field-effect transistor.

26. The invention of claim 25 wherein said input terminals of said amplifiers are coupled.

27. The invention of claim 26 wherein said input terminals of said amplifiers are coupled via a resistor.

28. The invention of claim 13 wherein said amplifier and said patches are optimized as one unit.

29. The invention of claim 13 wherein array antenna is terminated to appear as an infinite antenna.

30. A reflect array antenna comprising:

a plurality of unit cells, each ceil comprising:

a first vertically oriented patch antenna segment;

a second horizontally oriented patch antenna segment;

a third vertically oriented patch antenna segment;

a fourth horizontally oriented patch antenna segment;

a first amplifier coupled between said first patch segment and said second patch segment;

a second amplifier coupled between said third patch segment and said fourth patch segment; and an arrangement for coupling an input of said first amplifier to an input of said second amplifier, wherein the vertically oriented patch antenna segments of each unit cell are electrically coupled to vertically oriented patch antenna segments of other unit cells in a shared column and the horizontally oriented patch antenna segments of each unit cell are electrically coupled to horizontally oriented patch antenna segments of other unit cells in a shared row.

31. A method for generating millimeter wave energy including the steps of:

illuminating an array of unit cells with a low power source, said array comprising:

a plurality of unit cells, each cell comprising:

a first patch antenna segment;

a second patch antenna segment;

third patch antenna segment;

a fourth patch antenna segment;

a first amplifier coupled between said first patch segment and said second patch segment;

a second amplifier coupled between said third patch segment and said fourth patch segment; and an arrangement for coupling an input of said first amplifier to an input of said second amplifier, wherein at least one of said patch antenna segments of a first unit cell is electrically coupled to a patch antenna segment of a second unit cell;

applying power to said array whereby said array amplifies energy received from said low power source and retransmits said energy as an output millimeter wave beam.

32. An antenna cell comprising:

a first patch antenna segment;

a second patch antenna segment;

a third patch antenna segment;

a fourth patch antenna segment, said first and second patch segments being disposed in a mutually orthogonal relationship and said third and fourth patch segments being disposed in a mutually orthogonal relationship, said first and third patch segments being disposed in a mutually parallel relationship and said second and fourth patch segments being disposed in a mutually parallel relationship;

a first amplifier coupled between said first patch segment and said second patch segment;

a second amplifier coupled between said third patch segment and said fourth patch segment, wherein an input terminal of said first amplifier is coupled to said first patch antenna segment, an output terminal of said first amplifier is coupled to said second patch antenna segment, an input terminal of said second amplifier is coupled to said third patch antenna segment, an output terminal of said second amplifier is coupled to said fourth patch antenna segment and said first and said third patch segments are input patch segments and said second and fourth patch segments are output patch segments; and a tuning element between at least one of said patches and at least one of said amplifiers.

33. The invention of claim 32 wherein each of said amplifiers includes a field-effect transistor.

34. A reflect array antenna comprising:

a plurality of unit cells, each cell comprising:

a first patch antenna segment;

a second patch antenna segment;

a third patch antenna segment;

a fourth patch antenna segment; and an amplifier coupled between said first patch segment and said second patch segment or said third patch segment and said fourth patch segment;

and a tuning element between at least one of said patch segments and at least one of said amplifiers wherein at least one of said patch antenna segments of a first unit cell is electrically connected to a patch antenna segment of a second unit cell, an input terminal of said first amplifier of each cell is coupled to said first patch, antenna thereof, an output terminal of said first amplifier of each cell is coupled to said second patch antenna segment thereof, an input terminal of said second amplifier of each cell is coupled to said third patch antenna segment thereof, an output terminal of said second amplifier of each cell is coupled to said fourth patch antenna segment thereof, said first and said third patch segments of each cell are input patch segments and said second and fourth patch segments of each cell are output patch segments.

35. The invention of claim 34 wherein each of said amplifiers includes a field-effect transistor.

36. The invention of claim 35 wherein said input terminals of said amplifiers are coupled.

37. The invention of claim 36 wherein said input terminals of said amplifiers are coupled via a resistor.

* * * * *